United States Patent [19]

Piotrowski

[11] 4,046,519

[45] Sept. 6, 1977

[54] NOVEL MICROEMULSIONS

[75] Inventor: Alfred B. Piotrowski, Woodbury, N.J.

[73] Assignee: Mobil Oil Corporation, New York, N.Y.

[21] Appl. No.: 627,725

[22] Filed: Oct. 31, 1975

[51] Int. Cl.[2] ..... C10L 1/32

[52] U.S. Cl. ..... 44/51; 252/8.55 D; 252/312

[58] Field of Search ..... 44/51; 252/8.55 D, 312

[56] References Cited

U.S. PATENT DOCUMENTS

| | | | |
|---|---|---|---|
| 3,275,075 | 9/1966 | Gogarty et al. | 252/8.55 D |
| 3,508,611 | 4/1970 | Davis et al. | 252/8.55 D |
| 3,822,119 | 7/1974 | Frech et al. | 44/51 |
| 3,876,391 | 4/1975 | McCoy et al. | 44/51 |

OTHER PUBLICATIONS

The American Perfumer "Calculation HLB Values of Non-Ionic Surfactants" May, 1955, pp. 26–29.

*Primary Examiner*—Daniel E. Wyman
*Assistant Examiner*—Mrs. Y. Harris-Smith
*Attorney, Agent, or Firm*—Charles A. Huggett; Raymond W. Barclay; Howard M. Flournay

[57] ABSTRACT

A motor fuel in the form of a microemulsion is provided comprising a mixture of gasoline, methanol and water and a surfactant blend having a hydrophile-lipophile balance value of from about 3 to about 4.5.

2 Claims, No Drawings

NOVEL MICROEMULSIONS

BACKGROUND OF THE INVENTION

1. Field of the Invention

This invention relates to motor fuels in the form or microemulsions of gasoline employing methanol as an additional combustible component and water.

2. Description of the Prior Art

Prior to the present invention, the prior art, e.g. U.S. Pat. No. 3,876,391, has suggested the preparation of microemulsions comprising gasoline and water in combination with a surfactant for the purpose of increasing the quantity of water soluble additives that can be incorporated into the gasoline than is possible by employing the gasoline alone.

SUMMARY OF THE INVENTION

It is now found, in accordance with the present invention, that methanol, as an additional component to gasoline and water, which is often found in the bottoms of gasoline tanks, can be incorporated for the purpose of providing additional fuel values in the resulting microemulsion, in addition to water.

In more specific aspects of the invention, motor fuels, in the form of microemulsions, are provided comprising a mixture of gasoline, methanol and water and a surfactant blend having a hydrophile-lipophile balance (HLB) value of from about 3 to about 4.5. "HLB value" of the surfactant, denotes the relative simultaneous attraction that the surfactant demonstrates for water and oil. Thus, substances having a high HLB value above about 12 are highly hydrophilic (and poorly lipophilic), while substances having a low HLB value, below about 8, are lipophilic and consequently poorly hydrophilic. Substances having an HLB value of between about 8 and 12 are intermediate. A more complete discussion of HLB values appears in the literature, and particularly, "Emulsions Theory and Practice," by P. Becker, published by Reinhold Publishing Corporation, New York, 1957.

With the foregoing in view, an essential feature of the microemulsions of the present invention is that the HLB value be not lower than about 3 or higher than about 4.5. If the HLB value does not fall within the aforementioned narrow critical range, the motor fuel and methanol components, undergo phase separation. Contrasted with the microemulsion of the aforementioned U.S. Pat. No. 3,876,391, the novel emulsions of the present invention not only have HLB values outside the range specified in said patent but utilize methanol as an additional component for added fuel value. Furthermore, methanol, represents a relatively inexpensive, readily available, clean burning fuel which can be utilized as an additional component, thereby contributing to improved performance, better economy, lower exhaust temperatures, and lower emissions as compared with the use of gasoline alone.

In addition to gasoline, it is contemplated that other fluid products derived from petroleum refining, having an initial boiling point range from about 70° F to an end boiling point of about 650° F may be employed. Representative fractions include middle distillates (such as gas oils, furnace oils, diesel fuels and kerosene) as well as motor gasolines and aviation gasolines.

As herein before described, the surfactants of the novel microemulsions of the present invention are restricted to a critical HLB value of from about 3 to about 4.5. Any blend of the surfactants can be successfully employed within these HLB value limits. Representative of the surfactant blends that can be employed in forming the novel microemulsions are mixtures of mono and diglycerides of oleic acid: bis(2-hydroxyethyl)-stearylamine oxide.

Advantageously, the gasoline component of the microemulsion can be employed in a weight ratio of from about 80 to about 98. The methanol component can be employed in a weight ratio of from about 2 to about 19. The water component can be employed in a weight ratio of from about 0.1 to about 10.

If desired, the novel microemulsion of the present invention may contain a wide variety of water soluble additives for improving or favorably modifying some properties or characteristics of the motor fuel. Such additives may be employed for the purpose of improving octane or cetane number, surface ignition properties, smoke formation, exhaust emissions, metal deactivators or anti-icing agents and others.

DESCRIPTION OF SPECIFIC EMBODIMENTS

The following will serve to illustrate the preparation of the improved microemulsions of the present invention comprising gasoline, methanol and water, in combination with the above-described surfactant blends.

EXAMPLE

A surfactant blend was prepared by combining 9 parts by weight of mono and diglycerides of oleic acid, having an HLB value of 2.8, and 1 part, by weight, of bis(2-hydroxyethyl)stearylamine oxide, having an HLB value of 15. The combination of the surfactant blend was found to have an HLB value of 4. This comprised the same HLB value of 4, which was previously determined for a mixture of gasoline, methanol and water, in which the components of the mixture were present in a weight ratio of 94:5:1, respectively.

To 94 cc. of a gasoline were added about 1 gram of the above-described surfactant blend, with stirring, followed by the addition of 5 cc. of methanol. This mixture was stirred in a blender, and the 1 cc. of water was introduced. A homogenous clear dispersion resulted, which remained stable at room temperature.

In another modification of the foregoing procedure, the gasoline soluble component of the surfactant blend is dissolved in the gasoline and the water soluble component is dissolved in the alcohol-water mixture. Thereafter, by combining the gasoline and the aqueous methanol mixture in a blender, is foundto yield the same result.

While the present invention has been described with reference to preferred compositions and modifications, thereof, it will be apparent to those skilled in the art that departure from the preferred embodiments can be effectively made and are within the scope of the specification.

I claim:

1. A microemulsion comprising a mixture of gasoline, methanol and water and a surfactant blend having a hydrophile-lipophile balance value of about 4 wherein the surfactant blend comprises, by weight, a 9:1 mixture of mono and diglycerides of oleic acid: bis (2-hydroxyethyl)stearylamine oxide.

2. A microemulsion as defined in claim 1 wherein the gasoline component is present in a weight ratio of from about 80 to about 98; the methanol component is present in a weight ratio of from about 2 to about 19; and the water component is present in an amount from about 0.1 to about 10.

* * * * *